US005540548A

United States Patent [19]

Eberhardt et al.

[11] Patent Number: 5,540,548

[45] Date of Patent: Jul. 30, 1996

[54] REDUNDANT BLOWER UNIT

[75] Inventors: Anthony N. Eberhardt, Los Gatos; Eddie Y. Wong, Sunnyvale; Chin Y. Cheng, Cupertino; Mario J. Lee, Santa Clara, all of Calif.

[73] Assignee: Sun Microsystems, Inc., Mt. View, Calif.

[21] Appl. No.: 415,176

[22] Filed: Mar. 31, 1995

[51] Int. Cl.[6] ..... F04D 17/00

[52] U.S. Cl. ..... 415/182.1; 415/60; 454/184

[58] Field of Search ..... 415/60, 182.1, 415/220; 454/184

[56] References Cited

U.S. PATENT DOCUMENTS

| | | | |
|---|---|---|---|
| 1,283,288 | 10/1918 | Pfau | 415/60 |
| 3,658,442 | 4/1972 | Heitmann et al. | 415/60 |
| 5,000,079 | 3/1991 | Mardis | 415/220 |
| 5,409,419 | 4/1995 | Euchner | 454/184 |

FOREIGN PATENT DOCUMENTS

| | | | |
|---|---|---|---|
| 148700 | 11/1981 | Japan | 415/182.1 |

*Primary Examiner*—John T. Kwon

*Attorney, Agent, or Firm*—Julian Caplan; Flehr, Hohbach, Test, Albritton & Herbert

[57] ABSTRACT

A redundant blower unit is installed in a rack above another unit containing heat-emitting electrical elements (such as CPU cards) in order to draw air through the underlying unit and out to atmosphere. Four blowers in the blower unit draw air from a plenum, each blower discharging into an individual exhaust duct leading to the exterior. Two blowers are positioned at a first tier relative to the bottom of the plenum and the other two at a second tier higher than the first tier. If one blower fails, its exhaust duct may malfunction as an air inlet, in which case the incoming air is mixed with exhaust air and discharged through the other blower in the same tier as the failed blower. Thus the efficiency of the two blowers in the other tier is not impeded.

8 Claims, 2 Drawing Sheets

REDUNDANT BLOWER UNIT

BACKGROUND OF THE INVENTION

1. Field of the Invention

This invention relates to a redundant blower unit used to cool underlying heat emitting electrical elements such as a bank of CPU cards. The blower unit contains four blowers, two at a lower elevation and the other two at a higher elevation. The space between the bottoms of the blowers and the bottom of the unit constitutes a plenum which allows air drawn into the unit to circulate and expand from a straight line exit from the unit below. Each blower discharges into an individual exhaust duct, the ducts discharging horizontally sideward. If one blower fails, its exhaust duct becomes an air inlet. Arranging the blowers at different levels ensures that the air drawn through the duct of the failed blower will be blown out of the unit through the other blower at the same level as the failed blower. This enables the other two blowers at the other level to operate efficiently.

2. Description of Related Art

Blower units of substantially the same dimensions as the unit of the present invention have been used for similar purposes. However these units employ a single, large blower. When the large blower fails, the underlying electrical units overheat and may be considerably damaged. Other blower units have used multiple blowers but not arranged in tiers, as in the present invention. By using four separate blowers, the redundancy greatly reduces the likelihood of damage to the electrical elements being protected. When the air cooling means providing ventilation for devices which require such cooling fail, the device will fail. Hence it is desirable in such installations as computers to have a fail tolerant system. The present invention provides redundant blowers so that even with failure of one blower, there is adequate cooling.

The present invention employs four individual backward curved motorized impellers, all of which run simultaneously under normal operating conditions and are more than adequate to supply cooling to the computing unit which is located below the blower unit. A stopped or seized impeller or a burned out motor does not result in inadequate cooling because of the redundancy of the blowers.

The impellers are placed within the unit in such locations that there is little or no change in the ability of the redundant blowers to supply adequate cooling to the system regardless of which of the four impellers has actually failed.

The foregoing results are achieved by placing two blowers on each of two tiers. In normal operation with all four blowers functioning, hot air from the underlying heat emitting unit rises into a plenum at the bottom of the blower unit and then through each of the four blowers. The blowers discharge into individual ducts which direct the exhaust air horizontally sidewardly to the exterior.

If one blower fails, its exhaust duct becomes an air inlet. Since air takes the path of least resistance, air inletting through the failed blower duct flows into the blower at the same level (i.e., in the same tier) as the failed blower, mixing with some of the hot air emitted from the underlying unit. The bulk of the hot air goes through the two blowers in the other tier.

Failure of a blower is sensed by a tachometer sensor on its motor. A controller interprets the signals and provides a warning to the operator that one of the blowers has failed.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENT

Figure 1:
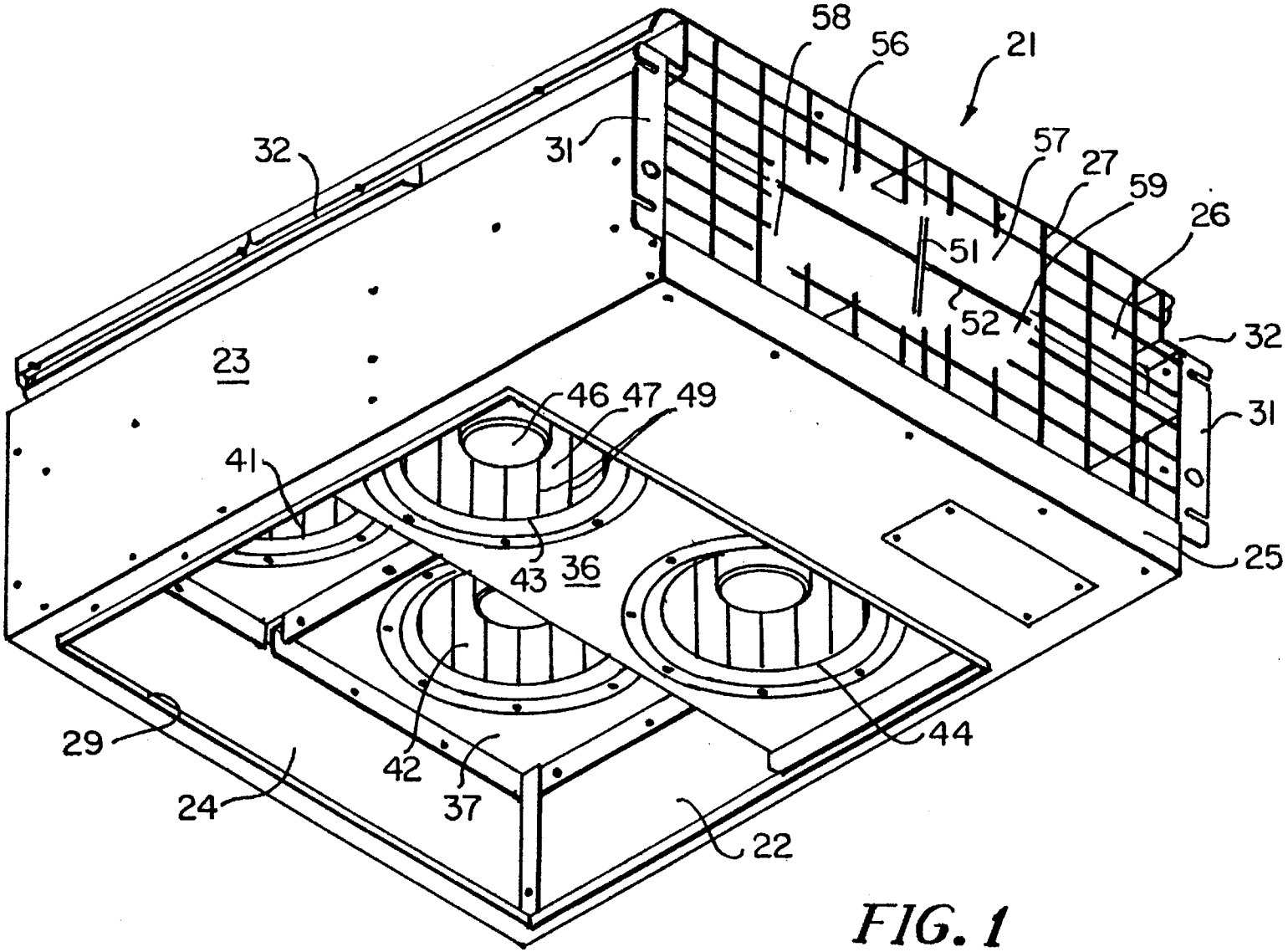
FIG. 1 is a perspective vies of the blower unit from below, partially broken away to reveal internal construction.
Figure 2:
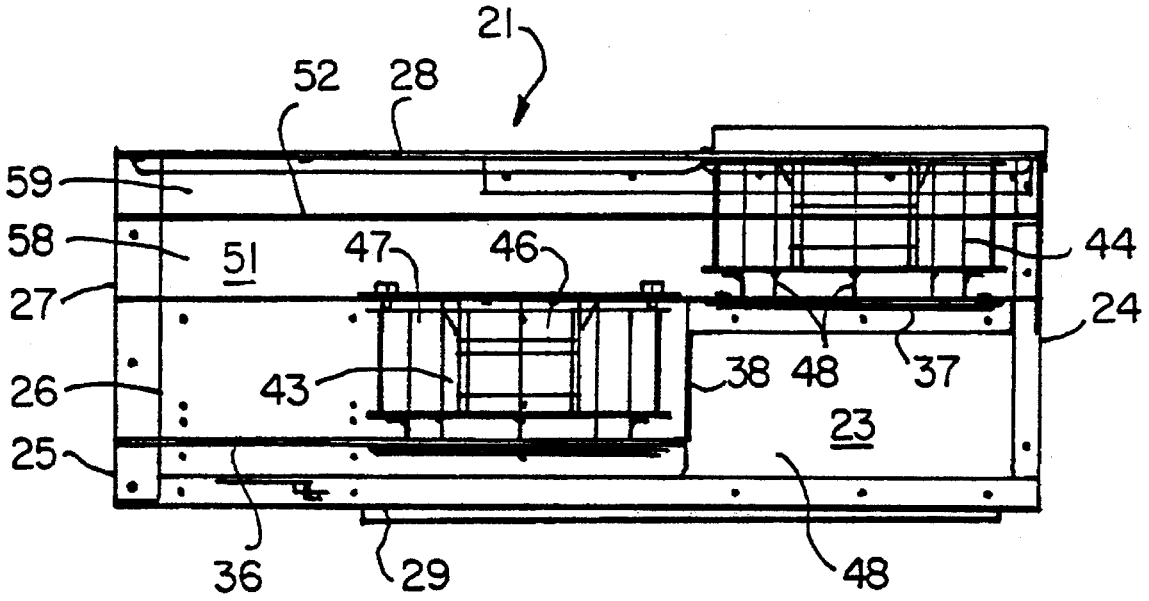
FIG. 2 is an enlarged vertical sectional view through said unit.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Blower module 21 is generally rectangular and is shaped to fit in a rack (not shown) immediately above and sealed to an underlying module containing heat emitting electrical elements such as CPU cards used in large computers. Module 21 comprises closed front 22, back 23 and one side 24. The side 26 opposite side 24 is a substantially open and protected by a grill 27. The lower edge of side 26 is closed by wall 25. The top 28 of module 21 is closed whereas the bottom 29 is open. Edge flanges 31 and track grooves 32 enable the module 21 to be slid horizontally into a rack (not shown) and secured in position by bolts (not shown).

Spaced a short distance above bottom 29 is a horizontal plenum partition 36 extending inward from side 26 and extending inward from closed side 24 is a second horizontal plenum partition 37 at a higher elevation than partition 36. The inner edges of partitions 36 and 37 are connected by vertical transverse plenum partition 38. Air rising through open bottom 29 is received and circulated in the plenum 48 as thus defined. It will be understood that the air drawn out of the underlying unit tends to travel in a straight line but the plenum 48 permits the air to expand from a straight line and to be drawn through each of the four impellers hereinafter described in approximately the same volume.

Above plenum 48 is a vertical duct partition 51 which extends between partitions 36 and 37 and top 28. Horizontal duct partition 52 extends from the upper edge of vertical plenum partition 38 to open side 26. Partitions 51 and 52 define four horizontal discharge ducts 56, 57, 58 and 59 which extend to open side 26.

Located at the inner end of each duct is a blower. Blowers 41–44 are commercially available products produced by Mc Lean Engineering, and more specifically Model PR674. It will be understood that other blowers may be used. As illustrated, each blower has a motor 46 and an impeller 47. Thus each blower 41–44 discharges air drawn from plenum 48 horizontally outwardly into its individual duct 56–59, respectively, and vents out through open side 26 through grill 27. The motor 46 of each blower has a vertical axis of revolution and is surrounded by annular, cage-like impeller 47 having backward curved blades 49. Thus blower 41 depends from partition 52 and fits into an opening in horizontal plenum partition 36 in what may be termed the lower tier of blowers. Similarly, blower 43 is located in the same tier and by the same elements but on the side of partition 38 opposite blower 41. On the other hand, blowers 42 and 44 depend respectively from top 28 aligned with openings in partition 37. Blowers 41 and 43 are located on opposite sides of vertical partition 51 as are blowers 42 and 44.

In normal operation, air in plenum 48 is distributed substantially equally to each of the four blowers 41–44. In the event that one of the blowers should fail for any reason, air may be drawn from the atmosphere through the duct associated with the failed blower into the plenum 48 where it is partially mixed with heated air. However, since air tends to travel the path of least resistance, instead of circulating throughout the plenum 48, the cold air is drawn into the operating blower in the same tier as the failed blower. This permits the two blowers in the other tier to operate normally.

Although not illustrated in the accompanying drawings, the motor 46 of each blower has associated therewith a tachometer sensor which provides a signal to the operator when a motor has slowed or stopped. Thereupon the operator may replace the unit and repair the failed blower.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A substantially rectangular redundant blower unit comprising a top, a front end, a back end, one closed side, a substantially open side and an open bottom, a lower plenum partition, an upper plenum partition disposed toward one end relative to said lower plenum partition and elevated above said lower plenum partition, a vertical partition connecting the inner edges of said upper and lower plenum partitions, said plenum partitions defining a plenum above said open bottom, a plurality of ducts above said plenum, a plurality of blowers each having an entrance at said plenum and a discharge into one said duct, each said blower discharging into a separate duct, at least two said blowers being located in a first tier and intercommunicating with each other at the level of said first tier and additional said blowers being located at a second tier higher than said first tier and intercommunicating with each other at the level of said second tier.

2. A blower unit according to claim 1 in which said blowers in said first tier are set in individual apertures in said lower plenum partition and said blowers in said second tier are set in individual apertures in upper plenum partition.

3. A blower unit according to claim 1 which further comprises a vertical duct partition extending down from said top and having a stepped lower edge secured to said lower and upper plenum partitions and a horizontal duct partition extending from the inner edge of said upper plenum partition to said open side, said duct partitions defining four horizontal ducts discharging out said open side.

4. A blower unit according to claim 3 in which said blowers in said first tier are located on opposite sides of said vertical duct partition and are suspended from said horizontal duct partition and said blowers of said second tier are located on opposite sides of said vertical duct partition and are suspended from said top.

5. A blower unit according to claim 1 in which each said blower has a vertical axis of revolution, having a motor and a cage-like impeller having backward curved blades and discharging approximately perpendicular to said vertical axis.

6. A blower unit according to claim 1 arranged so that upon failure of one said blower, air entering from outside said unit through said one said blower is discharged through another said blower in the same tier as said one said blower.

7. A substantially rectangular redundant blower unit comprising a top, a front end, a back end, one closed side, a substantially open side and an open bottom, a lower plenum partition, an upper plenum partition disposed toward one end relative to said lower plenum partition and elevated above said lower plenum partition, a vertical partition connecting the inner edges of said upper and lower plenum partitions, said plenum partitions defining a plenum above said open bottom, a plurality of blowers each having an entrance at said plenum, at least two said blowers being located in a first tier and intercommunicating with each other at the level of said first tier and at least two said blowers being located at a second tier higher than said first tier and intercommunicating with each other at the level of said second tier.

8. A blower unit according to claim 7 in which said blowers in said first tier are set in individual apertures in said lower plenum partition and said blowers in said second tier are set in individual apertures in upper plenum partition.

* * * * *